United States Patent [19]

Fender

[11] Patent Number: 4,671,157

[45] Date of Patent: Jun. 9, 1987

[54] VIBRATO ASSEMBLY

[76] Inventor: C. Leo Fender, 1510 Dana Pl., Fullerton, Calif. 92635

[21] Appl. No.: 801,474

[22] Filed: Nov. 25, 1985

[51] Int. Cl.[4] ..... G10D 3/12

[52] U.S. Cl. ..... 84/313

[58] Field of Search ..... 84/313

[56] References Cited

U.S. PATENT DOCUMENTS 3,241,418 3/1966 Fender ..... 84/313

4,512,232 4/1985 Schaller ..... 84/313

*Primary Examiner*—Lawrence R. Franklin

*Attorney, Agent, or Firm*—Spensley Horn Jubas & Lubitz

[57] ABSTRACT

A vibrato bridge assembly of an electric guitar is provided with a rotatable vibrato arm secured to a base plate by means of a bushing having a smooth-walled hole into which the arm fits. A set screw is provided to tighten against the arm to compensate for the tendency of the arm to become loose in the bushing.

2 Claims, 3 Drawing Figures

VIBRATO ASSEMBLY

BACKGROUND OF THE INVENTION

1. Field of the Invention

The present invention relates to musical instruments and more particularly to electric guitars. Still more particularly, the invention relates to an improved vibrato bridge assembly for an electric guitar.

2. Description of the Prior Art

Vibrato bridge assemblies for electric guitars typically include a base plate which is pivotally secured to the body of the guitar. Strings are secured to the bridge assembly and extend across the body and neck of the guitar and are secured at their other ends to string posts on the head of the guitar. A lever arm is secured to the base plate to facilitate the pivoting thereof with respect to the body. The pivoting action alters the tension on the strings and is employed to achieve a vibrato effect.

The vibrato lever arm is typically an L-shaped arm which is screwed into a threaded bushing on the base plate. The lever arm is intended to be rotatable within the bushing so that the player can adjust it to the most comfortable position. The assembly is designed so that the arm has a predetermined amount of friction in the bushing in order to give it the proper feel. Although it is intended that the arm be rotatable in the bushing, it should not have an undue amount of play either in rotation to position it or in pivoting to impart vibrato effects. If the arm becomes too loose, it will have a very sloppy and low quality feel to it.

The threaded connection between the vibrato arm and base plate bushing has a natural tendency to loosen over time. In order to maintain the proper feel of the assembly, players generally thread the arm further into the bushing to take any play out of the lever arm and regain the proper feel. The problem then arises that at some point the arm is turned too far and it destroys the threaded connection and/or the arm is broken off entirely.

SUMMARY OF THE INVENTION

The present invention is directed to a vibrato bridge assembly in which the threaded connection between the bridge plate bushing and vibrato arm is eliminated. Instead, a bushing having a smooth-walled cylindrical hole is provided and the end of the vibrato arm is also smooth. The arm fits into the hole in a close-mating relationship. In addition, the end of the arm may be slotted and the two end portions slightly bent away from each other to provide a spring effect when the arm is inserted into the bushing. In order to control the friction and thus the amount of play of the arm in the opening, a cushioned set screw is provided in the bushing and is tightened to contact the arm. Whenever the play of the arm increases beyond an acceptable extent, the set screw is simply tightened to increase the friction it applies to the arm. Proper feel may therefore be maintained without deterioration of the assembly.

BRIEF DESCRIPTION OF THE DRAWINGS

The invention will be described with reference to the accompanying drawings, wherein.

DESCRIPTION OF THE PREFERRED EMBODIMENT

The following description is of the best presently contemplated mode of carrying out the invention. This description is made for the purpose of illustrating the general principles of the invention and is not to be taken in a limiting sense. The scope of the invention is best determined by reference to the appended claims.

Figure 1:
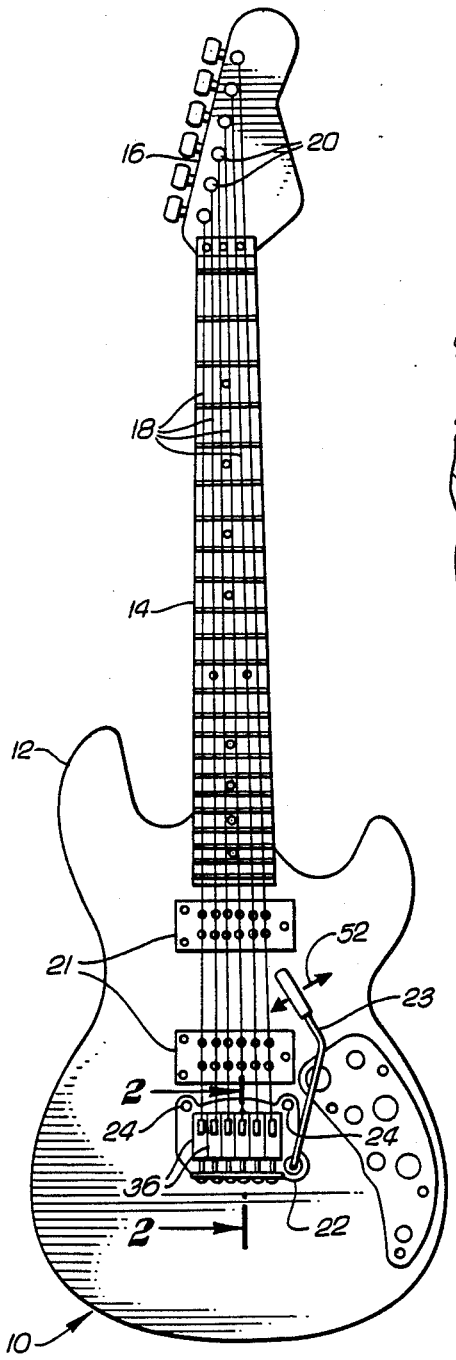
FIG. 1 is a top plan view of an electric guitar incorporating a vibrato assembly.

Referring to FIG. 1, an electric guitar 10 includes a body 12, a neck 14 and a head 16. Strings 18 extend from string posts 20 on the head 16 to a bridge assembly 22 on the body 12. Electromagnetic pick-up assemblies 21 are located on the body underneath the strings. The bridge assembly 22 is a vibrato-type assembly and includes a vibrato lever arm 23.

Figure 2:
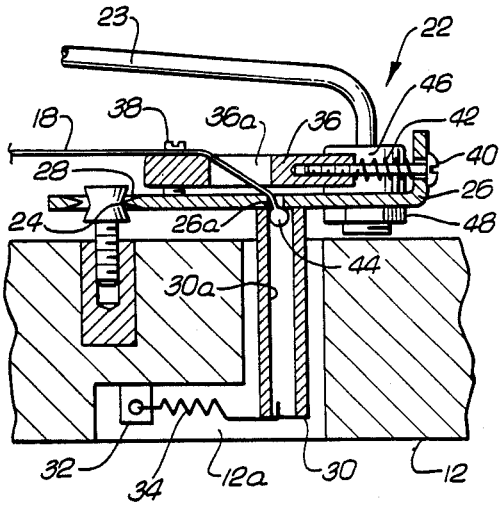
FIG. 2 is a sectional view of a portion of the body of the guitar showing the vibrato assembly.

Referring to FIGS. 1 and 2, the vibrato bridge assembly 22 is pivotally mounted with respect to the body 12 by means of knife edge bearings 24 which are anchored in the body. The vibrato assembly includes a base plate 26 including holes 28 having knife edges which contact the bearings 24. A counterweight 30 is secured to the underside of the base plate 26 and passes through a hole **12*a* in the body. An anchor 32 is attached to the body in the area of the hole 12*a*, and a spring 34 is connected between the anchor and the counterweight 30**.

A plurality of saddle assemblies 36 are carried on the top of the base plate 26, with one saddle assembly being provided for each string 18. The saddle assembly 36 is spaced from the base plate 26 by means of a pair of forward mounted screws 38 (only one of which is shown in FIG. 2) and a rear screw 40. A spring 42 is positioned around the screw 40 and biases the saddle assembly toward the neck. Each saddle assembly includes an opening **36*a* and the base plate 26 includes an opening 26*a* adjacent each saddle opening. A string ball 44 is located under the opening 26*a* in a hole 30*a* in the counterweight, and a string 18 passes through the openings 36*a* and 26*a* and is attached to the string ball 44**.

The tension of the strings 18 operates against the tension of the spring 34 and serve to maintain the knife edge 28 in contact with the bearing 24. A vibrato effect is achieved by pivoting the base plate 26 with respect to the bearing 24. This is accomplished by moving the vibrato lever arm 23 in a repetitive up and down fashion, i.e., away from and toward the body 12. This motion alters the tension on the strings 18, thereby producing a vibrato effect.

Figure 3:
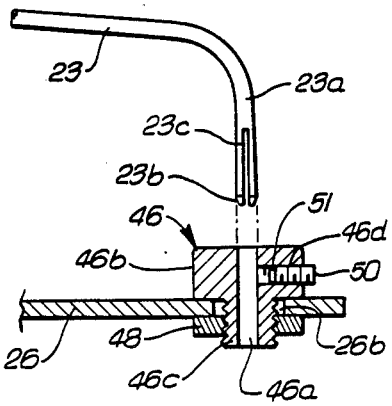
FIG. 3 is a sectional view of the lever arm assembly showing the lever arm removed from the bushing.

The vibrato arm assembly is seen most clearly in FIGS. 2 and 3. The vibrato arm 23 is a generally L-shaped arm and is typically formed of steel. A first leg **23*a* of the arm includes a smooth cylindrical surface and a tapered end 23*b*. A longitudinal slot 23*c*** is formed at the end of the leg by machining or otherwise, and the two end portions are bent slightly away from each other.

The leg **23*a* fits into a cylindrical smooth-walled hole 46*a* of a bushing 46. The bushing includes a head 46*b* and threaded body 46*c*. The body passes through a hole 26*b* in the base plate 26 and is secured with respect to the base plate by means of a hex nut 48. The bushing 46 also includes a threaded hole 46*d* which intersects the hole 46*a*, and a screw 50 having a hex head socket is threaded into the hole 46*d*. A nylon cushion 51 is attached to the end of the screw and contacts the leg 23*a*** when the screw is tightened.

The leg 23*a* is inserted into the opening 46*a* and is only slightly smaller in diameter than the opening so as to provide a close tolerance fit. In addition, the spring action provided by the provision of the slot 23*c* further increases the tightness of the connection. The arm 23 is rotatable within the hole 46*a* as indicated by an arrow 52 in FIG. 1. This enables the guitar player to position the arm at the most comfortable location.

Due to the motion of the arm, both for rotation and for the pivoting action to achieve vibrato effects, the arm 23 has a tendency to become loose in the hole 46*a*. This results in a sloppy and generally poor quality feel to the vibrato assembly. The screw 50 is provided in order to enable the proper amount of friction to be maintained between the leg 23*a* and the bushing 46 thereby to maintain the most desirable operating characteristics. The cushion 51 avoids metal to metal contact which could cause burring of the leg 23*a*. Even though the vibrato arm will have a tendency to loosen after time, this tendency is compensated for simply by tightening the cushioned screw 50. Reliable, long-life operation is thus obtained with a very simple structure.

What is claimed is:

1. A vibrato bridge assembly for an electric guitar, comprising:

a base plate have a hole passing therethrough;

a bushing having a head and a threaded body, said bushing passing through the hole so that the head abuts the base plate, said bushing have a smooth-walled cylindrical hole passing through the head and the body and a threaded hole in the head which intersects the cylindrical hole;

a nut threaded onto the body on the side of the base plate opposite the head to secure the bushing to the base plate;

a generally L-shaped metal lever arm having a first leg having a smooth cylindrical surface which is located in the cylindrical hole in close mating relationship with the wall of the hole; the first leg having a longitudinal slot at its end, the portions of the leg to either side of the slot being bent away from each other to provide a spring effect against the wall of the cylindrical hole; and a set screw in the threaded hole, said set screw contacting the first leg.

2. A vibrato bridge assembly as in claim 1 wherein the end of the first leg is tapered.

* * * * *